US007024767B1

(12) United States Patent
Lai

(10) Patent No.: US 7,024,767 B1
(45) Date of Patent: Apr. 11, 2006

(54) METHOD FOR MAKING TERMINAL

(75) Inventor: Chih-Ming Lai, Sindian (TW)

(73) Assignee: Giga-Byte Technology Co., Ltd., Taipei (TW)

( * ) Notice: Subject to any disclaimer, the term of this patent is extended or adjusted under 35 U.S.C. 154(b) by 0 days.

(21) Appl. No.: 11/078,434

(22) Filed: Mar. 14, 2005

(51) Int. Cl.
*H01R 43/16* (2006.01)
*H01R 13/432* (2006.01)
*B05D 1/18* (2006.01)

(52) U.S. Cl. ..... 29/874; 29/858; 29/861; 29/875; 29/883; 29/885; 427/435; 439/746

(58) Field of Classification Search ..... 29/874, 29/875, 883, 885, 858, 861; 264/272.11, 264/305; 427/435, 443.2; 439/885, 876, 439/746, 749
See application file for complete search history.

(56) References Cited

U.S. PATENT DOCUMENTS 4,243,289 A * 1/1981 Kozel ..... 439/562
4,619,495 A * 10/1986 Sochor ..... 439/637
4,929,193 A * 5/1990 Taylor ..... 439/567
5,957,739 A * 9/1999 Bianca et al. ..... 439/885

* cited by examiner

*Primary Examiner*—A. Dexter Tugbang
*Assistant Examiner*—Tai Van Nguyen
(74) *Attorney, Agent, or Firm*—Rosenberg, Klein & Lee

(57) ABSTRACT

A method for making a terminal includes forming a reinforcement enclosed around the pieces of the distal end of the terminal to combine and connect the pieces. Thus, the pieces of the distal end of the terminal are connected closely by the reinforcement to form a compact conic body without forming an opening in the distal end of the terminal, so that the distal end of the terminal has a greater structural strength, thereby preventing the distal end of the terminal from being broken or worn out due to mutual hit when the distal end of the terminal is inserted into a female terminal in a misalignment manner.

2 Claims, 5 Drawing Sheets

METHOD FOR MAKING TERMINAL

BACKGROUND OF THE INVENTION

1. Field of the Invention

The present invention relates to a method for making a terminal and the product thereof, and more particularly to a method for making a terminal of a power connector of the main board of a computer.

2. Description of the Related Art

A conventional connector device in accordance with the prior art shown in FIG. 11 comprises a main board power connector 6, and an electric power wire connector 5 inserted into the main board power connector 6.

As shown in FIG. 12, the electric power wire connector 5 has a female terminal 50, and the main board power connector 6 has a male terminal 60 having a distal end provided with three triangular bent pieces 600 co-operating to form a conic shape with an opening defined between the triangular pieces 600, so that the distal end of the male terminal 60 is formed with an opening 601. When the distal end of the male terminal 60 is inserted into the female terminal 50 in a misalignment manner, the peripheral wall of the female terminal 50 is easily locked into the opening 601 of the distal end of the male terminal 60, thereby distorting and deforming the triangular pieces 600 of the distal end of the male terminal 60, so that the male terminal 60 is easily worn out or broken due to collision between the male terminal 60 and the female terminal 50.

SUMMARY OF THE INVENTION

The primary objective of the present invention is to provide a method for making a terminal having a greater structural strength and having a smooth guidance effect.

Another objective of the present invention is to provide a method for making a terminal, wherein the pieces of the distal end of the terminal are connected closely to form a compact conic body without forming an opening in the distal end of the terminal, so that the distal end of the terminal has a greater structural strength, thereby preventing the distal end of the terminal from being broken or worn out due to mutual hit when the distal end of the terminal is inserted into a female terminal in a misalignment manner.

In accordance with one embodiment of the present invention, there is provided a method for making a terminal, comprising:

a) stamping a conductive metallic plate to form a terminal having a distal end provided with a plurality of pieces co-operating to form a conic shape;

b) impregnating the distal end of the terminal into a conductive thermoplastic solution, so that the thermoplastic solution is attached onto a surface of the distal end of the terminal; and c) removing the distal end of the terminal from the thermoplastic solution, so that after the thermoplastic solution attached onto the surface of the distal end of the terminal is cooled and solidified, the distal end of the terminal is formed with a reinforcement enclosed around the pieces.

In accordance with another embodiment of the present invention, there is provided a method for making a terminal, comprising:

a) stamping a conductive metallic plate to form a terminal having a distal end provided with a plurality of pieces co-operating to form a conic shape;

b) attaching a conductive metallic material onto the terminal; and c) heating the conductive metallic material until the conductive metallic material is melted to form a metallic solution which flows to and is attached onto a surface of the distal end of the terminal, so that after the metallic solution attached onto the surface of the distal end of the terminal is cooled and solidified, the distal end of the terminal is formed with a reinforcement enclosed around the pieces.

In accordance with another embodiment of the present invention, there is provided a terminal, comprising a distal end provided with a plurality of pieces, and a reinforcement mounted on the pieces, wherein the pieces co-operates to form a predetermined shape, and the reinforcement is enclosed around the pieces to combine and connect the pieces.

Further benefits and advantages of the present invention will become apparent after a careful reading of the detailed description with appropriate reference to the accompanying drawings.

DETAILED DESCRIPTION OF THE INVENTION

Figure 3:
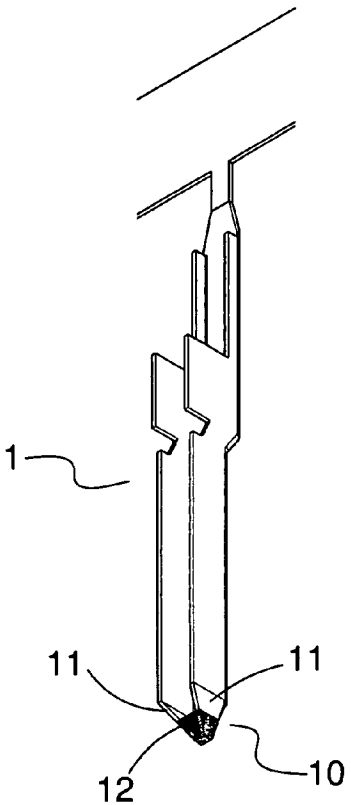
FIG. 3 is a perspective view showing the third step of the method in accordance with the first preferred embodiment of the present invention.

Referring to the drawings and initially to FIGS. 1–3, a method for making a terminal in accordance with the first preferred embodiment of the present invention comprises the steps described as follows.

Figure 1:
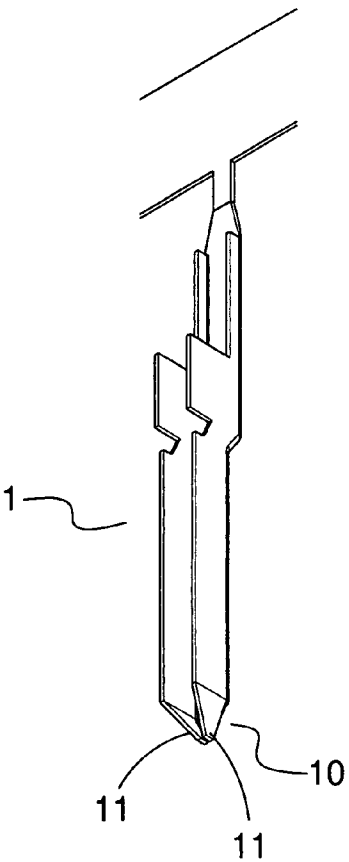
FIG. 1 is a perspective view showing the first step of a method in accordance with the first preferred embodiment of the present invention.

As shown in FIG. 1, a conductive metallic plate is stamped to form a terminal 1 having a distal end 10 provided with a plurality of pieces 11 co-operating to form a conic shape.

Figure 2:
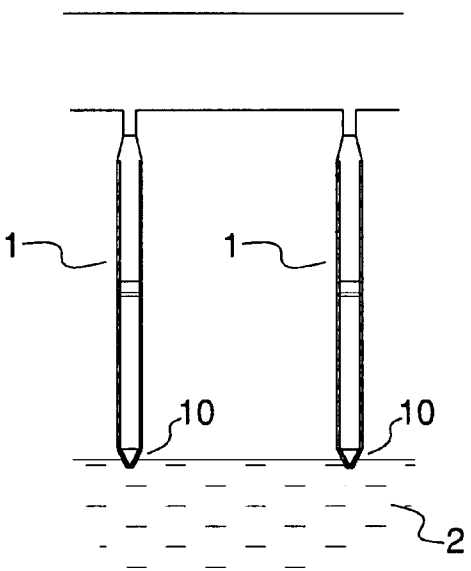
FIG. 2 is a plan view showing the second step of the method in accordance with the first preferred embodiment of the present invention.

Then, as shown in FIG. 2, the distal end 10 of the terminal 1 is impregnated into a conductive thermoplastic solution 2, so that the thermoplastic solution 2 is attached onto the surface of the distal end 10 of the terminal 1. In the preferred embodiment of the present invention, the thermoplastic solution 2 is a conductive rubber solution or a conductive metallic solution, such as a soldering tin conductive metallic solution.

Finally, as shown in FIG. 3, the distal end 10 of the terminal 1 is removed from the thermoplastic solution 2, so that after the thermoplastic solution 2 attached onto the surface of the distal end 10 of the terminal 1 is cooled and solidified, the distal end 10 of the terminal 1 is formed with a reinforcement 12 enclosed around the pieces 11.

Figure 6:
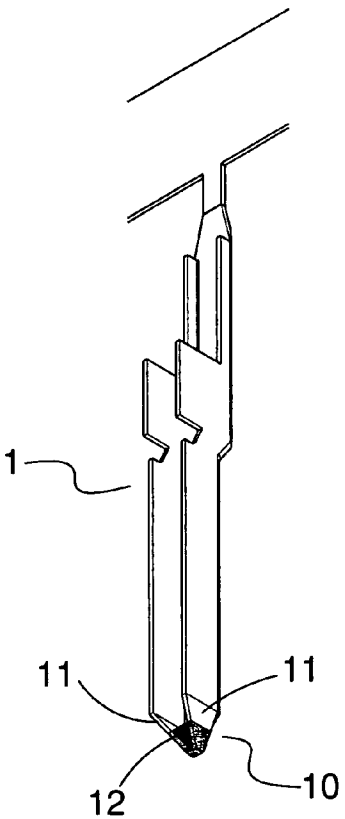
FIG. 6 is a perspective view showing the third step of the method in accordance with the second preferred embodiment of the present invention.
Figure 5:
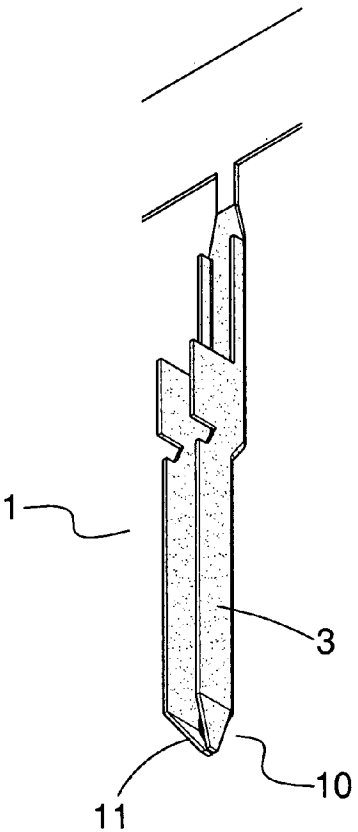
FIG. 5 is a perspective view showing the second step of the method in accordance with the second preferred embodiment of the present invention.
Figure 4:
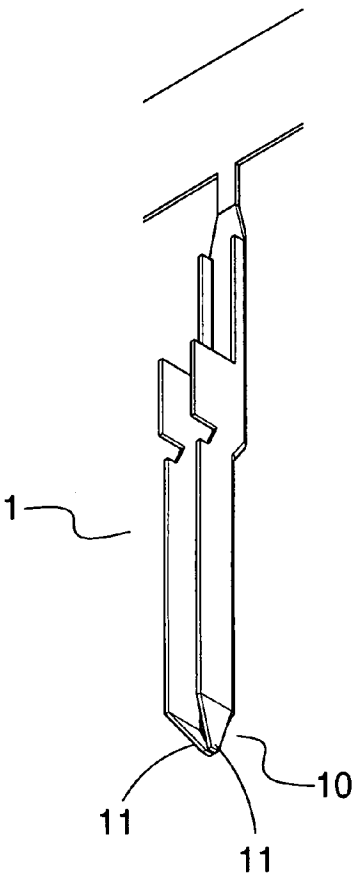
FIG. 4 is a perspective view showing the first step of a method in accordance with the second preferred embodiment of the present invention.

Referring to FIGS. 4–6, a method for making a terminal in accordance with the second preferred embodiment of the present invention comprises the steps described as follows.

As shown in FIG. 4, a conductive metallic plate is stamped to form a terminal 1 having a distal end 10 provided with a plurality of pieces 11 co-operating to form a conic shape.

Then, as shown in FIG. 5, a conductive metallic layer 3 is electroplated onto the surface of the terminal 1. In the preferred embodiment of the present invention, the conductive metallic layer 3 is a soldering tin layer having a greater thickness.

Finally, as shown in FIG. 6, the conductive metallic layer 3 is heated and melted to form a metallic solution which flows to and is attached onto the surface of the distal end 10 of the terminal 1, so that after the metallic solution attached onto the surface of the distal end 10 of the terminal 1 is cooled and solidified, the distal end 10 of the terminal 1 is formed with a reinforcement 12 enclosed around the pieces 11.

Figure 9:
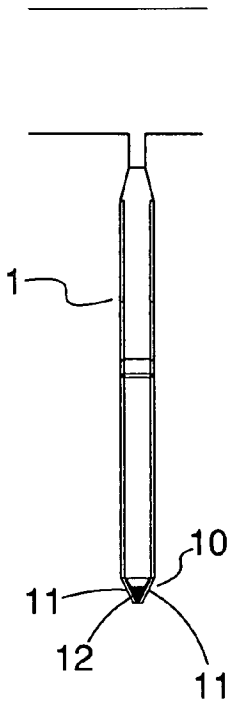
FIG. 9 is a plan view showing the third step of the method in accordance with the third preferred embodiment of the present invention.
Figure 8:
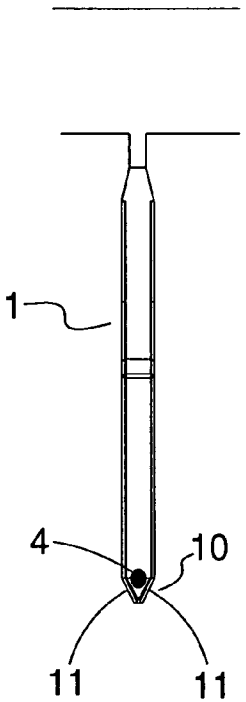
FIG. 8 is a plan view showing the second step of the method in accordance with the third preferred embodiment of the present invention.
Figure 7:
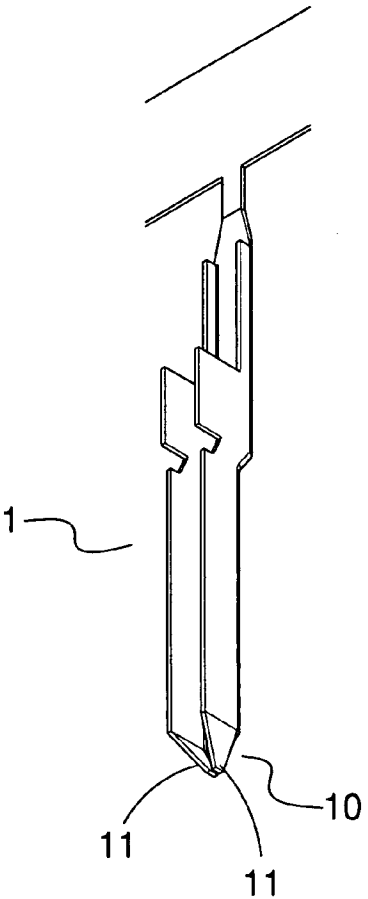
FIG. 7 is a perspective view showing the first step of a method in accordance with the third preferred embodiment of the present invention.
Figure 11:
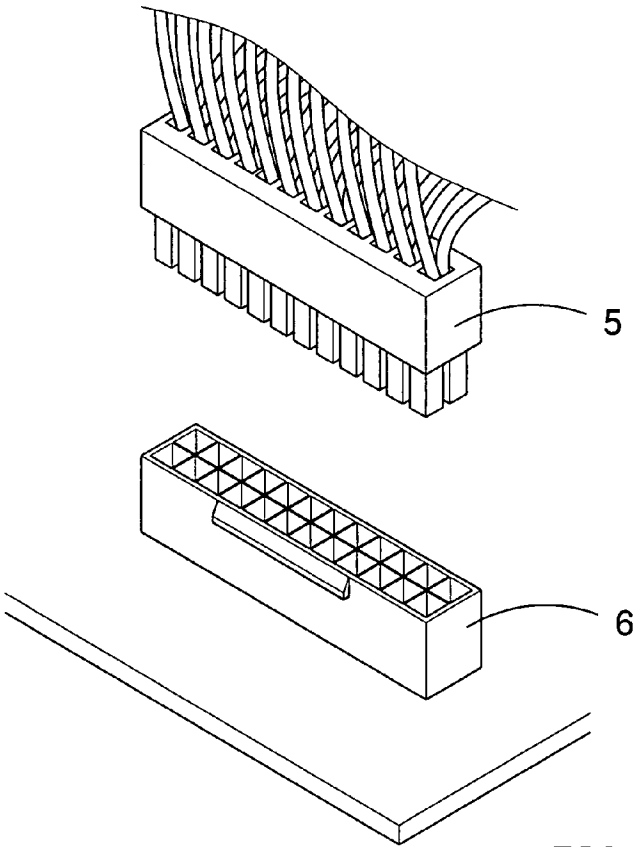
FIG. 11 PRIOR ART
FIG. 11 is an exploded perspective view of a conventional connector device in accordance with the prior art.

Referring to FIGS. 7–9, a method for making a terminal in accordance with the third preferred embodiment of the present invention comprises the steps described as follows.

As shown in FIG. 7, a conductive metallic plate is stamped to form a terminal 1 having a distal end 10 provided with a plurality of pieces 11 co-operating to form a conic shape.

Then, as shown in FIG. 8, a conductive metallic material 4 is sputtered into the distal end 10 of the terminal 1. In the preferred embodiment of the present invention, the conductive metallic material 4 is soldering tin material.

Finally, as shown in FIG. 9, the conductive metallic material 4 is heated and melted to form a metallic solution which flows to and is attached onto the surface of the distal end 10 of the terminal 1, so that after the metallic solution attached onto the surface of the distal end 10 of the terminal 1 is cooled and solidified, the distal end 10 of the terminal 1 is formed with a reinforcement 12 enclosed around the pieces 11.

Figure 10:
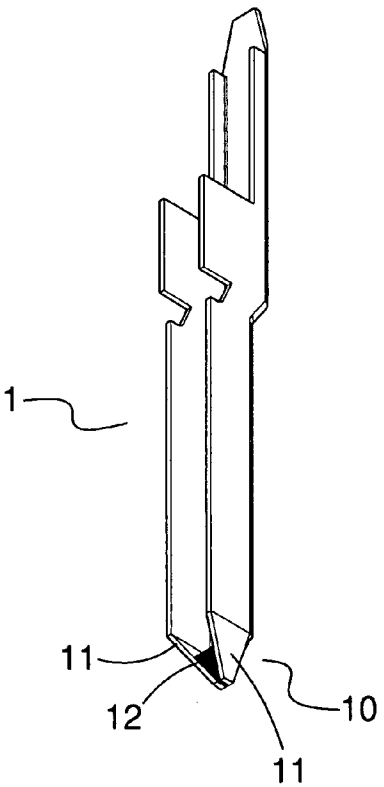
FIG. 10 is a perspective view of a terminal in accordance with the preferred embodiment of the present invention.
Figure 12:
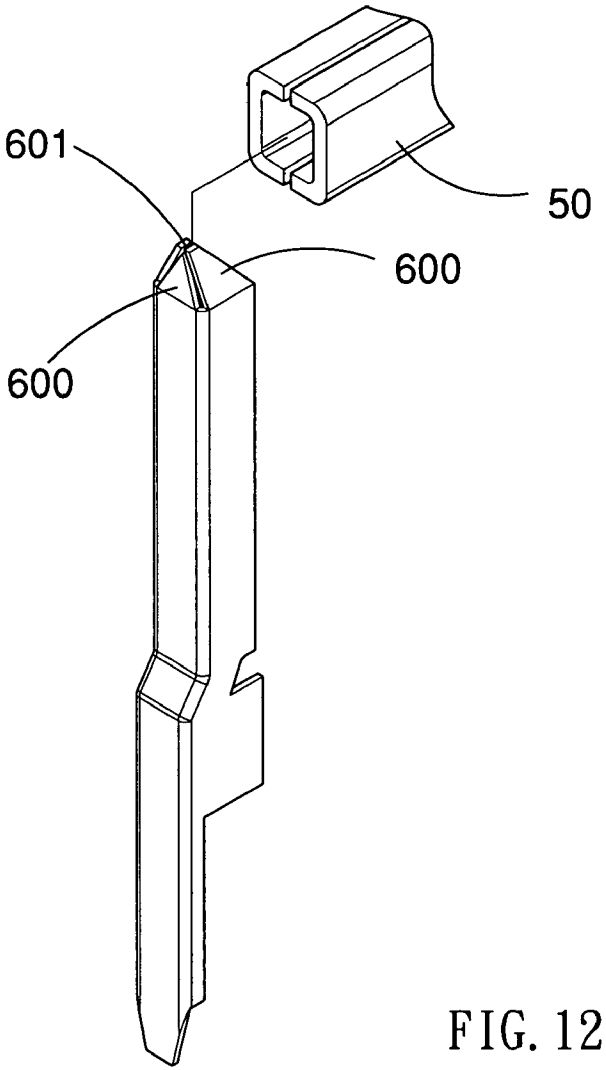
FIG. 12 PRIOR ART
FIG. 12 is an exploded perspective view of a conventional terminal in accordance with the prior art.

Referring to FIG. 10, a terminal 1 in accordance with the preferred embodiment of the present invention has a distal end 10 provided with a plurality of pieces 11, and a reinforcement 12 mounted on the pieces 11. The pieces 11 co-operates to form a conic shape. The reinforcement 12 is enclosed around the pieces 11 to combine the pieces 11, so that the pieces 11 are connected closely to form a compact conic body without forming an opening in the distal end 10 of the terminal 1. In addition, the pieces 11 are connected closely to have a greater structural strength and have a guidance effect.

Accordingly, the pieces 11 are connected closely to form a compact conic body without forming an opening in the distal end 10 of the terminal 1, so that the distal end 10 of the terminal 1 has a greater structural strength and has a smooth guidance effect, thereby preventing the distal end 10 of the terminal 1 from being broken or worn out due to mutual hit when the distal end 10 of the terminal 1 is inserted into a female terminal in a misalignment manner.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A method for making a terminal, comprising:

a) stamping a conductive metallic plate to form a terminal having a distal end provided with a plurality of pieces co-operating to form a conic shape;

b) impregnating the distal end of the terminal into a conductive thermoplastic solution, so that the thermoplastic solution is attached onto a surface of the distal end of the terminal; and c) removing the distal end of the terminal from the thermoplastic solution, so that after the thermoplastic solution attached onto the surface of the distal end of the terminal is cooled and solidified, the distal end of the terminal is formed with a reinforcement enclosed around the pieces.

2. The method in accordance with claim 1, wherein the thermoplastic solution is selectively chosen from the group of a conductive rubber solution and a conductive metallic solution.

* * * * *